United States Patent [19]

Masaki et al.

[11] 3,934,411

[45] Jan. 27, 1976

[54] SYSTEM FOR REDUCING POLLUTANTS IN ENGINE EXHAUST GAS

[75] Inventors: Kenji Masaki, Yokohama; Mitinobu Konno, Yokosuka, both of Japan

[73] Assignee: Nissan Motor Company Limited, Yokohama, Japan

[22] Filed: Aug. 12, 1974

[21] Appl. No.: 496,893

[30] Foreign Application Priority Data

Aug. 17, 1973 Japan ..... 48-92289

[52] U.S. Cl. ..... 60/286; 60/282; 60/303; 60/305

[51] Int. Cl.[2] ..... F02B 75/10

[58] Field of Search ..... 60/286, 282, 303, 285, 60/305, 301

[56] References Cited

UNITED STATES PATENTS

| | | | |
|---|---|---|---|
| 3,413,803 | 12/1968 | Rosenlund | 60/282 |
| 3,708,980 | 1/1973 | Truxell | 60/301 |
| 3,785,153 | 1/1974 | Schwing | 60/305 |
| 3,791,144 | 2/1974 | Lang | 60/301 |
| 3,827,237 | 8/1974 | Linder | 60/301 |

*Primary Examiner*—Douglas Hart

[57] ABSTRACT

Two differently composed exhaust gases, one rich in air and the other in unburned fuel and CO, are alternately supplied to a thermal reactor in dependence on the firing sequence of engine cylinders. The thermal reactor is made up of a cylindrical inner body directly connected to an exhaust manifold at its middle and provided with exhaust holes in both ends, and an outer body forming a space between the two bodies.

8 Claims, 3 Drawing Figures

SYSTEM FOR REDUCING POLLUTANTS IN ENGINE EXHAUST GAS

The present invention relates to a system for reducing concentrations of harmful substances in multi-cylinder internal combustion engine exhaust gases, in which system two differently composed exhaust gases, one rich in unburned fuel and the other in air, are supplied alternately to a thermal reactor.

Concentrations of harmful substances in an internal combustion engine exhaust gas are greatly dependent on the air to fuel ratio (A/F) of a combustible mixture fed to the engine. When an A/F near the stoichiometric ratio is employed, the maximum concentration of nitrogen oxides (NOx) is produced and concentrations of carbon monoxide (CO) and unburned hydrocarbons (HC) are also considerably high though not maximum. A lower A/F, or a rich mixture, causes HC and CO to increase, and a higher A/F or a lean mixture causes these two substances to decrease, particularly CO, while NOx is decreased in both cases.

It is, however, very hard to reduce concentrations of HC and CO in the exhaust gas to values low enough to meet current requirements merely by employment of either a considerably rich or lean mixture. Accordingly, a thermal reactor or after-burner is frequently used to convert the discharged HC and CO into harmless oxides even when A/F is deviated from the stoichiometric value. It may seem quite favorable in such a case to use a lean mixture putting the above facts together, but CO shows an extremely poor reactivity with air in a low concentrations and/or at relatively low temperatures. Thus, a rich mixture is more favorable because the resulting large amounts of HC and CO can be more easily oxidized in a suitable thermal reactor while NOx is inherently decreased as mentioned above. For practical application, however, a rich mixture is quite unfavorable from the viewpoint of fuel economy.

It is therefore a major object of the present invention to provide a system for effectively reducing concentrations of harmful substances in an exhaust gas from a typical internal combustion engine having an even number of combustion chambers accompanied with substantially no increase in fuel consumption.

It is another object of the invention to provide such a system which maintains its function even when the engine is operated at such a low load as to cause the exhaust gas temperature to fall.

In brief, a system of the invention for an internal combustion engine having an even number of combustion chambers comprises; an exhaust manifold communicable with all the combustion chambers, a thermal reactor made up of a cylindrical inner body forming a reaction chamber therein and a cylindrical outer body enclosing the inner body with a space therebetween, and means to cause the exhaust manifold to discharge two differently composed exhaust gases alternately in dependence on the firing sequence of the combustion chambers, the first of which exhaust gases contains relatively large amounts of carbon monoxide and unburned fuel and the second a relatively large amount of air but relatively amall amounts of carbon monoxide and unburned fuel. The inlet of the thermal reactor is located in the central region of the peripheral wall of the inner body and is connected with the outlet of the exhaust manifold. The space between the two bodies is isolated from the inlet and communicates with the reaction chamber through holes formed in both end regions of the inner body, and the discharge port of the thermal reactor is formed in the central region of the peripheral wall of the outer body. The system may further comprise means to supply auxiliary air to the first exhaust gas when the engine load is below a predetermined value so that a portion of the unburned fuel may burn within the exhaust manifold, preventing an excessive temperature reduction of the first exhaust gas.

Other features and advantages of the invention will become clear from the following detailed description of preferred embodiments thereof taken with the accompanying drawings, in which.

Figure 1:
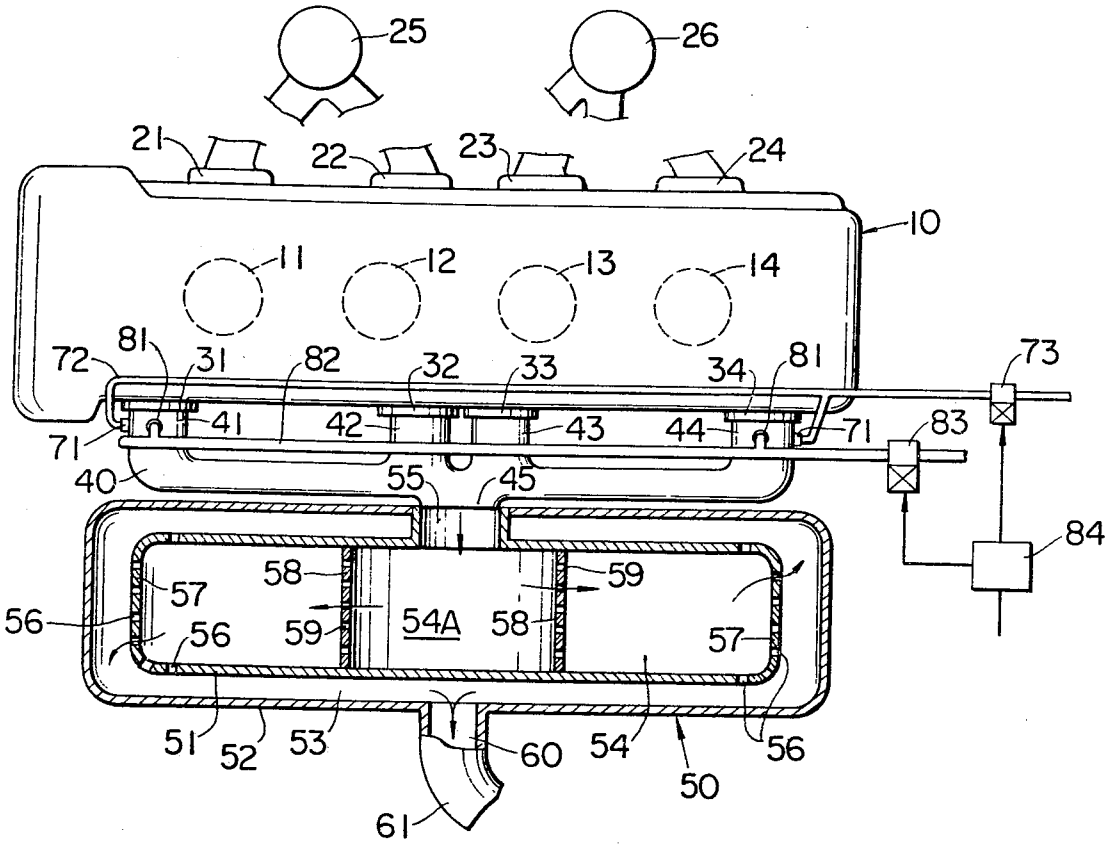
FIG. 1 is a plan view, partially in section, of a four-cylinder engine provided with a system of the invention.

In FIG. 1, an engine 10 has four cylinders or combustion chambers 11, 12, 13 and 14 provided with, respectively, intake ports 21–24 and exhaust ports 31–34. An exhaust manifold 40 having four branches 41–44 is connected to the exhaust ports 31–34, and an outlet 45 thereof is connected to a thermal reactor 50. The thermal reactor 50 essentially consists of a cylindrical inner body 51 and a cylindrical outer body 52 enclosing the former 51 to form a space 53 between the two bodies 51 and 52. An interior space or reaction chamber 54 in the inner body 51 communicates with the exhaust manifold 40 through an inlet 55 formed in the middle of the peripheral wall of the inner body 51. The inlet 55 extends across the space 53 and through the wall of the outer body 52 in a manner as to be isolated from the space 53. The reaction chamber 54 communicates with the exterior space 53 through a plurality of holes 56 formed through the wall of the inner body 51 at both ends 57 and peripheral regions close thereto. Two partitions 58 are preferably disposed in the reaction chamber 54 at locations between the inlet 55 and the ends 57 to divide the reaction chamber 54 into three sections. A plurality of through holes 59 in the partitions 58 allows the thus formed central section 54A to communicate with the remainder sections of the reaction chamber 54. The outer body 52 has a discharge port 60 in the middle of the peripheral wall thereof, which is connected to an exhaust pipe 61.

In the engine 10, the firing sequence of the four cylinders 11–14 is 11-12-14-13 as is customarily employed. According to the present invention an exhaust gas from, for example, the combustion chamber 11 is caused to differ in composition from another exhaust gas from the combustion chamber 12 which is fired next. For that purpose, a relatively rich air/fuel mixture having a low A/F of, for example, 12/1 is supplied to the cylinders 11 and 14 from a carburetting system 25, and another carburetting system 26 supplies a relatively lean mixture of, for example, an A/F of 18/1 to the remaining cylinders 12 and 13.

In operation, the cylinder 11 discharges a first type of exhaust gas containing large amounts of CO and unburned fuel or HC into the central section 54A of the reaction chamber 54 through the exhaust manifold 40. The cylinder 12 is fired next, and a second type of exhaust gas containing air in large excess but only small amounts of CO and HC flows into the central section 54A. Subsequently the first type of exhaust gas is again discharged from the cylinder 14, thus the two differently composed exhaust gases are alternately supplied to the thermal reactor 40.

Due to retardation of the exhaust gas flow by the partitions 58, the two different composed exhaust gases mix with each other in the central section 54A. Upon mixing, CO and HC in the first exhaust gas begin to react with the excess and heated air in the second exhaust gas. The burning reactions proceed during the subsequent flow of the mixed exhaust gas from the central or mixing section 54A to the main sections of the reaction chamber 54 through the holes 59. The mixed exhaust gas then flows into the space 53 surrounding the inner body 51 through the holes 56 in the end region and rounds towards the middle of the reactor 40, where the discharge port 60 is disposed. It is to be noted that the burning of large amounts of HC and CO in the reaction chamber 54 allows the fractional amount of CO which is contained originally in the second exhaust gas to be oxidized without difficulty.

Such a long route in the thermal reactor 50 allows the mixed exhaust gas to remain therein for a period long enough to accomplish oxidation of almost whole CO and HC contained initially therein. Besides affording a long reaction time, the passage of the heated exhaust gas, either burning or burnt, around the inner body 51 causes the reaction chamber 54 to be maintained at elevated temperatures, so that the oxidation reactions can be initiated with ease and proceed smoothly.

Thus, an extremely clean exhaust gas is discharged into the exhaust pipe 61 as the result of efficient oxidation of CO and HC in the thermal reactor 50 and the inherent low concentration of NOx due to the initial deviations of A/F values from the stoichiometric ratio.

The provision of the partitions 58 is usually preferable as mentioned above, but similar results may be obtained without them if the length to diameter ratio of the reaction chamber 54 and the arrangement of the holes 56 are designed appropriately.

It will be self-evident that the firing sequence of the cylinders 11–14 is not limited to 11-12-14-13 but may alternatively be 11-13-14-12 and that the apportionment of the rich air/fuel mixture to the pair of the cylinders 11 and 14 and the lean mixture to the other pair 12 and 13 may be reversed. The firing sequence and the apportionment of the mixtures may be combined in any way so long as the above described two different composed exhaust gases are produced alternately in accordance with the sequential firing of the cylinders 11–14.

Figure 2:
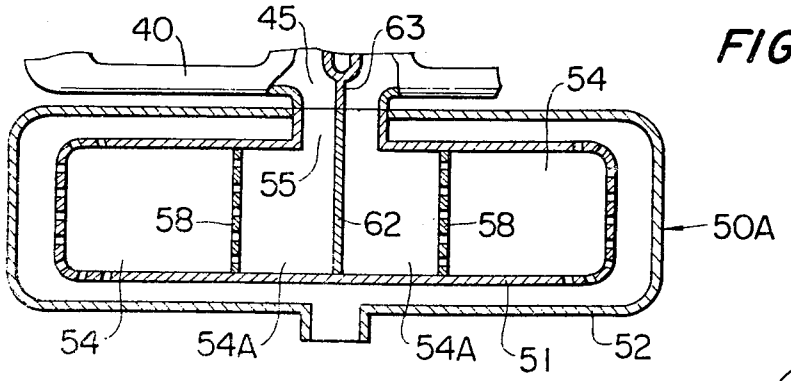
FIG. 2 is a longitudinal sectional view of a thermal reactor similar to that shown in FIG. 1 but incorporating a small modification.

Referring now to FIG. 2, a thermal reactor 50A essentially similar to the reactor 50 of FIG. 1 has a dividing wall 62 transversely disposed in the center of the reaction chamber 54 to divide the central section 54A thereof into two halves. The dividing wall 62 extends through the inlet 55 dividing it also into two halves. Also the outlet 45 of the exhaust manifold 40 is divided into two sections by a dividing wall 63.

In this arrangement, the first type of exhaust gas from the cylinder 11 is mixed with only the second exhaust gas from the cylinder 12 in the left side region of the mixing section 54A, and the exhaust gases from the cylinders 13 and 14 are similarly mixed with each other in the right side. Consequently, the mixing of the two differently composed exhaust gases can be accomplished more efficiently and achieving a more accurate mixing ratio.

It will be apparent that the thermal reactor 50A and/or the exhaust manifold 40 may be provided with two inlets 55 and/or two outlets 45, respectively, in place of the extension and/or provision of the dividing walls 62 and/or 63.

Referring again to FIG. 1, the two sets of carburetting systems 25 and 26 for producing the two types of air/fuel mixtures may be replaced with a fuel injection system (not shown) controlled to supply the cylinder pairs 11, 14 and 12, 13 with different quantities of fuel.

The two types of exhaust gases may alternatively be produced as follows. In place of feeding the engine 10 with the two types of air/fuel mixtures, all the cylinders 11–14 are fed with the above second or lean mixture. The two branches 41 and 44 of the exhaust manifold 40 are equipped with secondary fuel injection nozzles 71 at locations close to the exhaust ports 31 and 34, respectively, which fuel nozzles 71 are connected to a fuel supply system (not shown) through a secondary fuel duct 72. With the enrichment of the exhaust gas from the cylinders 11 and 14 with unburned fuel by means of the fuel nozzles 71 it is easy to initiate and sustain the burning reaction of the resulting gas with the air-rich exhaust gas from the cylinders 12 and 13 in the reaction chamber 54. Thus the low concentration of CO can be oxidized almost entirely. The amount of the fuel supply from the fuel nozzles 71 is preferably regulated proportionally to the amount of air induction to the intake ports 21–24 of the engine 10.

The branches 41 and 44 of the exhaust manifold 40 are preferably equipped with auxiliary air nozzles 81 at locations close to the exhaust ports 31 and 34, respectively. An air duct 82 for these nozzles 81 is governed by a solenoid valve 83, which is normally closed and is energized to its open position by a control unit 84 having means to sense the engine load and a switch. When the load on the engine 10 falls to such a value that the temperature of the first exhaust gas from the cylinders 11 and 14 becomes too low to achieve the expected reactions in the thermal reactor 50, the control unit 84 operates the valve 83 to feed secondary or auxiliary air into the first exhaust gas through the air duct 82 and the nozzles 81. As a result, a portion of the unburned fuel in the first exhaust gas is burned within the exhaust manifold 40, allowing the exhaust gas temperature to rise sufficiently prior to entrance of the exhaust gas into the reactor 50.

In addition to the auxiliary air, the first exhaust gas is preferably enriched with fuel during such a low-load operation of the engine 10 to promote the above described after-burning in the exhaust manifold 40. The enrichment may be accomplished by controlling the A/F of the combustible mixture to be fed to the combustion chambers 11 and 14. When the aforementioned fuel nozzles 71 are employed, such fuel enrichment can be accomplished simply by regulating the fuel supply rate from the secondary fuel nozzles 71. For example, a solenoid valve 73 is provided in the fuel duct 72, and the control unit 84 is arranged to operate the two valves 83 and 73 simultaneously. The valve 73 to the fuel duct 72 is normally kept partially open, and the opening thereof is enlarged by a power from the control unit 84 in response to the engine load reduction.

Figure 3:
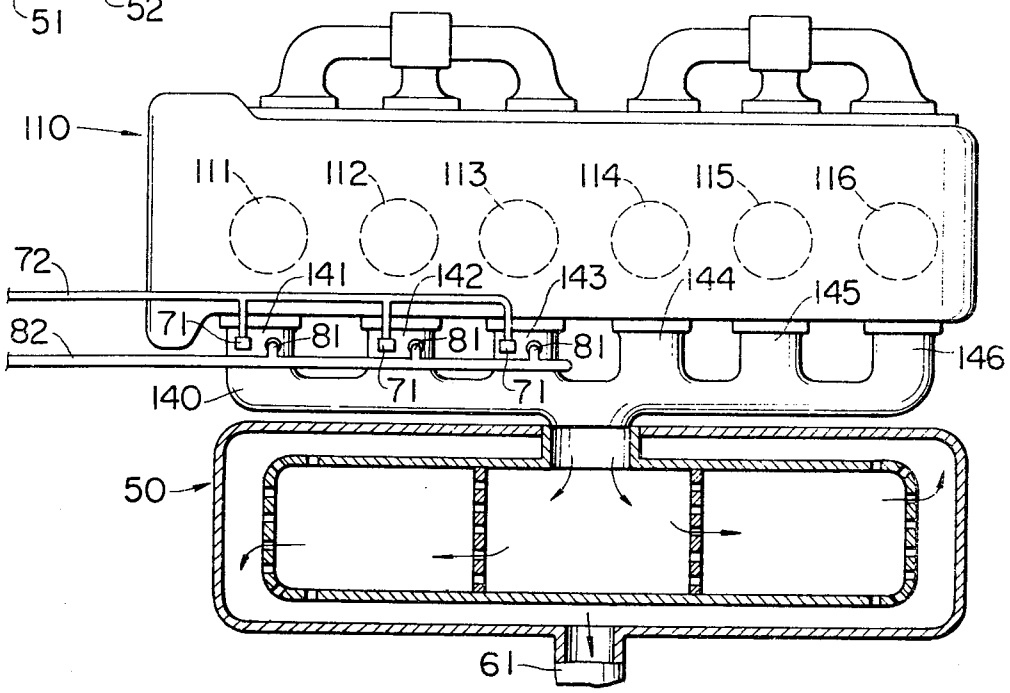
FIG. 3 is a plan view similar to FIG. 1, but showing a six-cylinder engine.

A system of the invention is applicable to various internal combustion engines having an even number of cylinders other than the four-cylinder engine 10. For example, a six-cylinder engine 110 of FIG. 3 is provided with a system identical with that of FIG. 1 except that an exhaust manifold 140 with six branches 141–146 is employed. A customary firing sequence of six combustion chambers 111-115-113-116-112-114 is employed in this engine 110. Accordingly, a relatively rich air/fuel mixture is fed to a set of the cylinders 111, 112 and 113, and a relatively lean mixture to the remainder cylinders 114, 115 and 116. The reverse apportionment is of course permissible. Consequently, the aforementioned first and second exhaust gases flow alternately into the thermal reactor 50 and react with each other in exactly the same way as in the case of FIG. 1. The dividing wall 62 of FIG. 2, however, is unnecessary in this case since the first and second exhaust gases flow always through the left side and right side of the exhaust manifold 140, respectively.

The exhaust manifold 140 may be equipped with the auxiliary air nozzles 81 and the secondary fuel nozzles 71 similarly to the exhaust manifold 40 of FIG. 1 except for the growth in number.

What is claimed is:

1. A system for reducing concentrations of harmful substances in an exhaust gas from an internal combustion engine before emission into the atmosphere, the engine having an even number of combustion chambers, the system comprising:

an exhaust manifold communicable with the combustion chambers of the engine and having an outlet;

a thermal reactor made up of a cylindrical inner body forming a reaction chamber therein and having an inlet located in the central region of the peripheral wall thereof and connected with said outlet of said exhaust manifold and a cylindrical outer body arranged to enclose said inner body with a space therebetween and provided with a discharge port formed in the central region of the peripheral wall thereof, said space communicating with said reaction chamber through holes formed in both end regions of said inner body and being isolated from said inlet; and first means to cause said exhaust manifold to discharge two differently composed exhaust gases alternately in dependence on the firing sequence of the combustion chambers, the first of said exhaust gases containing relatively large amounts of carbon monoxide and unburned fuel and the second containing relatively small amounts of carbon monoxide and unburned fuel and a relatively large amount of air.

2. A system according to claim 1, in which said first means form and supply a first air-fuel mixture of an air/fuel ratio below the stoichiometric ratio to a first group of combustion chambers consisting of one half of the combustion chambers and a second air-fuel mixture of an air/fuel ratio above the stoichiometric ratio to a second group consisting of other half of the combustion chambers, said first and second groups being formed in such a manner that each combustion chamber of said first group is fired alternately in sequence with a combustion chamber of said second group.

3. A system according to claim 2, further comprising second means to supply auxiliary air to said first exhaust gas when the engine load is below a predetermined value so that a portion of said unburned fuel in said first exhaust gas may burn within said exhaust manifold to prevent an excessive temperature reduction of said first exhaust gas.

4. A system according to claim 3, in which said second means comprises at least one auxiliary air nozzle communicating with said exhaust manifold at a location close to said first group of combustion chambers, an air duct connected to said air nozzle, a normally closed valve disposed in said air duct and third means to cause said valve to open when the engine load is below a predetermined value.

5. A system according to claim 1, in which said first means comprises at least one secondary fuel nozzle disposed in said exhaust manifold at a location close to a first group of combustion chambers consisting of one half of the combustion chambers selected in such a manner that each thereof is fired alternately in sequence with one of the remaining combustion chambers forming a second group and a fuel duct connecting said fuel nozzle with a fuel supplying means, and wherein all combustion chambers are fed with an air-fuel mixture of an air/fuel ratio above the stoichiometric ratio.

6. A system according to claim 5, further comprising at least one auxiliary air nozzle disposed in said exhaust manifold at a location close to said fuel nozzle, an air duct connected to said air nozzle, a normally closed valve disposed in said air duct, a valve normally open partially and disposed in said fuel duct, the opening thereof being variable, and means to cause said normally closed valve to open and said opening of said normally open valve to enlarge when the engine load is below a predetermined value.

7. A system according to claim 1, in which said inner body of said thermal reactor further comprises two transverse partitions having a plurality of holes therethrough and disposed in said reaction chamber at locations between said inlet and said both end regions of said inner body dividing said reaction chamber into three cylindrical sections.

8. A system according to claim 7, in which said thermal reactor further comprises a dividing wall disposed transversely in the middle of said reaction chamber to divide the central cylindrical section into two halves, said dividing wall extending into said inlet to divide said inlet into two sections communicating with said two halves of cylindrical sections, respectively, and said outlet of said exhaust manifold is divided into two sections to communicate with said two sections of said inlet, respectively.

* * * * *